United States Patent [19]

Whitlock et al.

[11] Patent Number: 4,806,171

[45] Date of Patent: Feb. 21, 1989

[54] APPARATUS AND METHOD FOR REMOVING MINUTE PARTICLES FROM A SUBSTRATE

[75] Inventors: Walter H. Whitlock, Peapack; William R. Weltmer, Jr., Murray Hill; James D. Clark, Mountainside, all of N.J.

[73] Assignee: The BOC Group, Inc., Montvale, N.J.

[21] Appl. No.: 116,194

[22] Filed: Nov. 3, 1987

Related U.S. Application Data

[63] Continuation-in-part of Ser. No. 41,169, Apr. 22, 1987, abandoned.

[51] Int. Cl.[4] ..... B08B 7/00

[52] U.S. Cl. ..... 134/7; 134/93; 261/75; 261/89; 261/95; 261/158; 51/320; 51/410

[58] Field of Search ..... 134/7, 93–95; 51/320, 307, 410; 261/75, 89, 95–98, 158–161

[56] References Cited

U.S. PATENT DOCUMENTS

| | | | |
|---|---|---|---|
| 2,699,403 | 1/1955 | Courts | 134/7 |
| 3,074,822 | 1/1963 | Walk et al. | 134/7 |
| 4,389,820 | 6/1983 | Fong et al. | 51/410 |
| 4,655,847 | 4/1987 | Ichinoseki et al. | 134/7 |

OTHER PUBLICATIONS

Bangold, R.-*The Physics of Sand and Desert Dunes*, Chapman and Hall, London (1966) pp. 25–37.

Corn, M. "The Adhesion of Solid Particles to Solid Surface", J. Air. Poll. Cart. Assoc. vol. 11, No. 11 (1961) pp. 523–528.

Gallo, C. F. & Lama, W. C. "Classicial Electrostatic Description of the Work Function and Ionization Energy of Insulators", *IEEE Trans. Ind. Appl.* vol. LIA-12, No. 2 (Jan.-Feb. 1976) pp. 7–11.

Hoenig, S. A.-"Cleaning Surfaces with Dry Ice", *Compressed Air Magazine*, Aug., 1986, pp. 22–25).

Hoenig, S. A.-"The Application of Dry Ice to the Removal of Particulates from Optical Apparatus, Spacecraft, Semiconductor Wafers, and Equipment Used in Contaminant Free Manufacturing Processes", Sep. 1985.

*Primary Examiner*—H. M. S. Sneed

*Assistant Examiner*—Sharon T. Cohen

*Attorney, Agent, or Firm*—R. Hain Swope; Larry R. Cassett

[57] ABSTRACT

Apparatus for removing small particles from a substrate comprising a source of fluid carbon dioxide, a first means for expanding a portion of the fluid carbon dioxide into a first mixture containing gaseous carbon dioxide and fine droplets of liquid carbon dioxide, coalescing means for converting the first mixture into a second mixture containing gaseous carbon dioxide and larger liquid droplets of carbon dioxide, second expansion means for converting said second mixture into a third mixture containing solid particles of carbon dioxide and gaseous carbon dioxide, and means for directing said third mixture toward the substrate. Also disclosed are methods for removing fine particles from substrates utilizing the subject apparatus.

20 Claims, 4 Drawing Sheets

APPARATUS AND METHOD FOR REMOVING MINUTE PARTICLES FROM A SUBSTRATE

RELATED APPLICATIONS

This application is a continuation-in-part of U.S. patent application Ser. No. 41,169, filed Apr. 22, 1987 now abandoned.

The present invention is directed to apparatus and methods for removing minute particles from a substrate employing a stream containing solid and gaseous carbon dioxide. The apparatus of the invention is especially suited for removing submicron contaminants from semiconductor substrates.

BACKGROUND OF THE INVENTION

The removal of finely particulate surface contamination has been the subject of numerous investigations, especially in the semiconductor industry. Large particles, i.e. in excess of one micron, are easily removed by blowing with a dry nitrogen stream. However, submicron particles are highly resistant to removal by gaseous streams because such particles are more strongly bound to the substrate surface. This is due primarily to electrostatic forces and bonding of the particles by surface layers containing absorbed water and/or organic compounds. In addition, there is a boundry layer of nearly stagnant gas on the surface which is comparatively thick in relation to submicron particles. This layer shields submicron particles from forces which moving gas streams would otherwise exert on them at greater distances from the surface.

It is generally believed that the high degree of adhesion of submicron particles to a substrate is due to the relatively large surface area of the particles which provides greater contact with the substrate. Since such particles do not extend far from the surface area and therefore have less surface area exposed to the stream of a gas or liquid, they are not easily removed by aerodynamic drag effects as evidenced by studies of the movement of sand and other small particles. Bagnold, R. *The Physics of Sand and Desert Dunes,* Chapman and Hall, London (1966) pp 25–37; and Corn, M. "The Adhesion of Solid Particles to Solid Surfaces", *J. Air. Poll. Cart. Assoc.* Vol 11, No. 11 (1961) pp 523–528.

The semiconductor industry has employed high pressure liquids alone or in combination with fine bristled brushes to remove finely particulate contaminants from semiconductor wafers. While such processes have achieved some success in removing contaminants, they are disadvantageous because the brushes scratch the substrate surface and the high pressure liquids tend to erode the delicate surfaces and can even generate an undesirable electric discharge as noted by Gallo, C. F. and Lama, W. C., "Classical Electrostatic Description of the Work Function and Ionization Energy of Insulators", *IEEE TRANS. IND. APPL.* Vol 1A–12, No. 2 pp 7–11 (January/February 1976). Another disadvantage of the brush and high pressure liquid systems is that the liquids can not readily be collected after use.

In accordance with the present invention, a mixture of substantially pure solid and gaseous carbon dioxide has been found effective for removal of submicron particles from substrate surfaces without the disadvantages associated with the above-described brush and high pressure liquid systems.

More specifically, pure carbon dioxide (99.99+%) is available and can be expanded from the liquid state to produce dry ice snow which can be effectively blown across a surface to remove submicron particles without scratching the substrate surface. In addition, the carbon dioxide snow vaporizes when exposed to ambient temperatures leaving no residue and thereby eliminating the problem of fluid collection.

Ice and dry ice have been described as abrasive cleaners. For Example, E. J. Courts, in U.S. Pat. No. 2,699,403, discloses apparatus for producing ice flakes from water for cleaning the exterior surfaces of automobiles. U. C. Walt et al, in U.S. Pat. No. 3,074,822, disclose apparatus for generating a fluidized frozen dioxane and dry ice mixture for cleaning surfaces such as gas turbine blades. Walt et al state that dioxane is added to the dry ice because the latter does not evidence good abrasive and solvent action.

More recently, apparatus for making carbon dioxide snow and for directing a solid/gas mixture of carbon dioxide to a substrate has been disclosed. Hoenig, Stuart A., "Cleaning Surfaces with Dry Ice" (*Compressed Air Magazine,* August, 1986, pp 22–25). By device, liquid carbon dioxide is depressurized through a long, cylindrical tube of uniform diameter to produce a solid/gas carbon dioxide mixture which is then directed to the substrate surface. A concentrically positioned tube is used to add a flow of dry nitrogen gas to thereby prevent the build-up of condensation.

Despite being able to remove some submicron particles, the aforementioned device suffers from several disadvantages. For example, the cleaning effect is limited primarily due to the low gas velocity and the flaky and fluffy nature of the solid carbon dioxide. In addition, the geometry of the long cylindrical tube makes it difficult to control the carbon dioxide feed rate and the rate at which the snow stream contacts the substrate surface.

In accordance with this invention, there is provided a new aparatus for removing submicron particles from a substrate which overcomes the aforementioned disadvantages. The apparatus of this invention produces a solid/gas mixture of carbon dioxide at a controlled flow rate which effectively removes submicron particles from a substrate surface.

SUMMARY OF THE INVENTION

The present invention is directed to an apparatus for removing submicron particles from a substrate comprising:

(1) a source of fluid carbon dioxide;

(2) means for enabling the fluid carbon dioxide to expand into espective portions of fine liquid droplets and gaseous carbon dioxide;

(3) means for coalescing the fine liquid droplets into large liquid droplets;

(4) means for converting said large liquid droplets into solid particles of carbon dioxide in the presence of said gaseous carbon dioxide to thereby form a solid/gas mixture of carbon dioxide; and (5) means for directing said solid/gas mixture at said substrate.

More specifically, the present invention employs an orifice providing a pathway for the flow of fluid carbon dioxide into a coalescing chamber where the fine liquid droplets first form and then coalesce into large liquid droplets which are the precursor of the minute solid particles of carbon dioxide which are not normally resolvable by the human eye. The large droplets are formed into solid particles as the feed passes from the coalescing chamber through a second orifice and out of the exit port toward the substrate surface.

The following drawings and the embodiments described therein in which like reference numerals indicate like parts are illustrative of the present invention and are not meant to limit the scope of the invention as set forth in the claims forming part of the application.

DETAILED DESCRIPTION OF THE INVENTION

Figure 1:
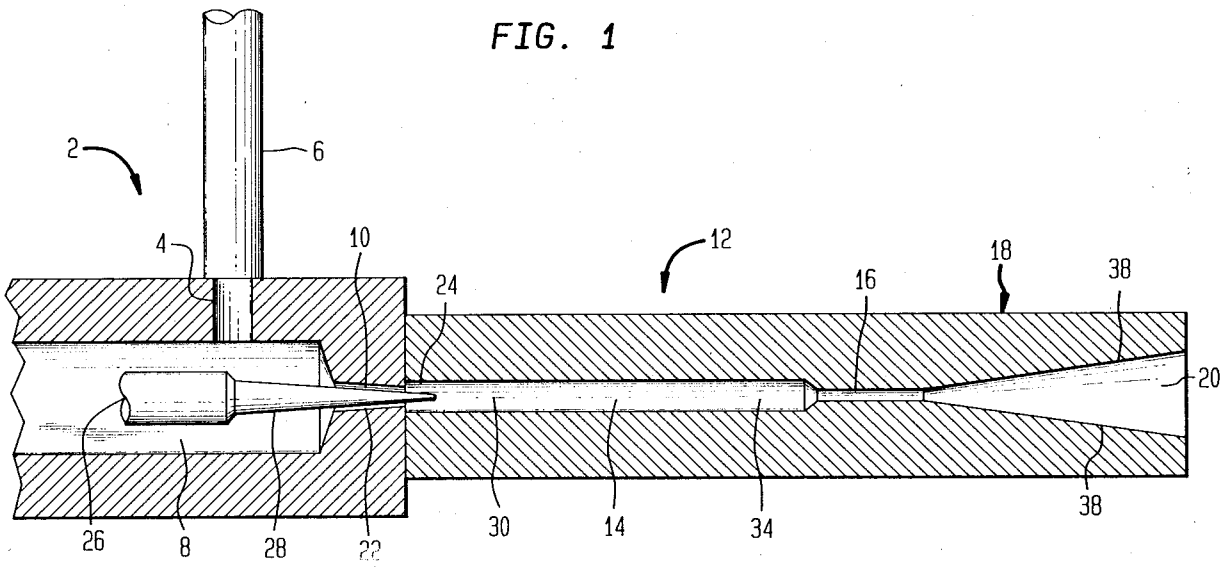
FIG. 1 is a cross-sectional elevational view of the apparatus of the present invention employing a needle valve to control the rate of formation of fine droplets of carbon dioxide.

Referring to the drawings, and specifically to FIG. 1, the apparatus 2 of the present invention includes a fluid carbon dioxide receiving port 4 which is connected to a fluid carbon dioxide storage facility (not shown) via connecting means 6. The connecting means 6 may be a steel reinforced Teflon hose or any other suitable connecting means which enables the fluid carbon dioxide to flow from the source to the receiving port 4.

There is also provided a chamber 8 which receives the fluid carbon dioxide as it flows through the receiving port 4. The chamber 8 is connected via a first orifice 10 to a nozzle 12. The nozzle 12 includes a coalescing chamber 14, a second orifice 16, and an ejection spout 18 terminating at an exit port 20.

The first orifice 10 includes walls 22 which taper toward an opening 24 into the coalescing chamber 14. The first orifice 10 is dimensioned to deliver about 0.25 to 0.75 standard cubic foot per minute of oarbon dioxide. The width of the first orifice 10 is suitably 0.030 to 0.050 inch and tapers slightly (e.g. about 1°), thus further accelerating the flow of the fluid carbon dioxide and contributing to the pressure drop resulting in the formation of the fine liquid droplets in the coalescing chamber 14.

In one embodiment of the invention as shown in FIG. 1, the first orifice 10 may be equipped with a standard needle valve 26 having a tapered snout 28 which is movable within the first orifice 10 to control the cross-sectional area thereof and thereby control the flow of the fluid carbon dioxide. In an alternative embodiment, the first orifice 10 may be used alone without a needle valve. In this event, the width or diameter of the orifice 10 is suitably from about 0.001 to about 0.050 inch. The needle valve 26 is preferred, however, because it provides control of the cross-sectional area of the first orifice 10. The needle valve 26 may be manipulated by methods customarily employed in the art, such as by the use of a remote electronic sensor.

The coalescing chamber 14 comprises a rearward section 30 adjacent the first orifice 10 and communicating therewith via the opening 24. The coalesinq chamber 14 also includes a forward section 34. The length of the coalescing chamber is suitably from about 0.125 to 2.0 inches, and the diameter is suitably from about 0.03 to 0.125 inch. However, it should be understood that the dimensions can vary according to the size of the job, for example, the size of the object to be cleaned. Although a coalescing chamber 14 having a larger diameter will provide denser particles and therefore greater cleaning intensity, it has been found that too large a diameter may result in freezing of moisture on the substrate surface which inhibits cleaning. This problem can be alleviated by lowering the ambient humidity. On the other hand, cleaning applications involving very delicate substrate surfaces may benefit from employing a small diameter coalescing chamber 14.

The diameter of the first orifice 10 can vary as well. However, if the diameter is too small, it becomes difficult to manufacture by the usual technique of drilling into bar stock. In general, the cross-sectional areas of the first orifice 10 and second orifice 16 are less than the cross-sectional area of the coalescing chamber 14.

The source of carbon dioxide utilized in this invention is a fluid source which is stored at a temperature and pressure above what is known as the "triple point" which is that point where either a liquid or a gas will turn to a solid upon removal of heat. It will be appreciated that, unless the fluid carbon dioxide is above the triple point, it will not pass the orifices of the apparatus of this invention.

The source of carbon dioxide contemplated herein is in a fluid state, i.e. liquid, gaseous or a mixture thereof, at a pressure of at least the freezing point pressure, or about 65 psia and, preferably, at least about 300 psia. The fluid carbon dioxide must be under sufficient pressure to control the flow through the first orifice 10. Typically, the fluid carbon dioxide is stored at ambient temperature at a pressure of from about 300 to 1000 psia, preferably at about 750 psia. It is necessary that the enthalpy of the fluid carbon dioxide feed stream under the above pressures be below about 135 BTU per pound, based on an enthalpy of zero at 150 psia for a saturated liquid. The enthalpy requirement is essential regardless of whether the fluid carbon dioxide is in a liquid, gaseous or, more commonly, a mixture, which typically is predominately liquid. If the subject apparatus is formed of a suitable metal, such as steel or tungsten carbide, the enthalpy of the stored fluid carbon dioxide can be from about 20 to 135 BTU/lb. In the event the subject apparatus is constructed of a resinous material such as, for example, high-impact polypropylene, we have found that the enthalpy can be from about 110 to 135 BTU/lb. These values hold true regardless of the ratio of liquid and gas in the fluid carbon dioxide source.

In operation, the fluid carbon dioxide exits the storage tank and proceeds through the connecting means 6 to the receiving port 4 where it then enters the storage chamber 8. The fluid carbon dioxide then flows through the first orifice 10, the size of which may, optionally, be regulated by the presence of the needle valve 26.

As the fluid carbon dioxide flows through the first orifice 10 and out the opening 24, it expands along a constant enthalpy line to about 80–100 psia as it enters the rearward section 30 of the coalescing chamber 14. As a result, a portion of the fluid carbon dioxide is converted to fine droplets. It will be appreciated that the state of the fluid carbon dioxide feed will determine the degree of change that takes place in the first coalescing chamber 14, e.g. saturated gas or pure liquid carbon dioxide in the source container will undergo a proportionately greater change than liquid/gas mixtures. The equilibrium temperature in the rearward section 30 is typically about −57° F. and, if the source is room temperature liquid carbon dioxide, the carbon dioxide in the rearward section 30 is formed into a mixture of about 50% fine liquid droplets and 50% carbon dioxide vapor. Conversely, if the source is saturated gas, the mixture formed in section 30 will be about 11% fine liquid droplets and 89% carbon dioxide vapor.

The fine liquid droplet/gas mixture continues to flow through the coalescing chamber 14 from the rearward section 30 to the forward section 34. As a result of additional exposure to the pressure drop in the coalescing chamber 14, the fine liquid droplets coalesce into larger liquid droplets. The larger liquid droplets/gas mixture forms into a solid/gas mixture as it proceeds through the second orifice 16 and out the exit port 20 of the ejection spout 18.

Walls 38 forming the ejection spout 18 and terminating at the exit port 20 are suitably tapered at an angle of divergence of about 4° to 8°, preferably about 6°. If the angle of divergence is too great (i.e. above about 15°), the intensity of the stream of solid/gas carbon dioxide will be reduced below that which is necessary to clean most substrates.

The coalescing chamber 14 serves to coalesce the fine liquid droplets created at the rearward section 30 thereof into larger liquid droplets in the forward section 34. The larger liquid droplets form minute, solid carbon dioxide particles as the carbon dioxide expands and exits toward the substrate at the exit port 20. In accordance with the present invention, the solid/gaseous carbon dioxide having the requisite enthalpy as described above, is subjected to desired pressure drops from the first orifice 10 through the coalescing chamber 14, the second orifice 16 and the ejection spout 18.

Although the present embodiment incorporates two stages of expansion, those skilled in the art will recognize that nozzles having three or more stages of expansion may also be used.

The apparatus of the present invention may, optionally, be equipped with a means for surrounding the solid carbon dioxide/gas mixture as it contacts the substrate with a nitrogen gas envelope to thereby minimize condensation of the substrate surface.

Figure 2:
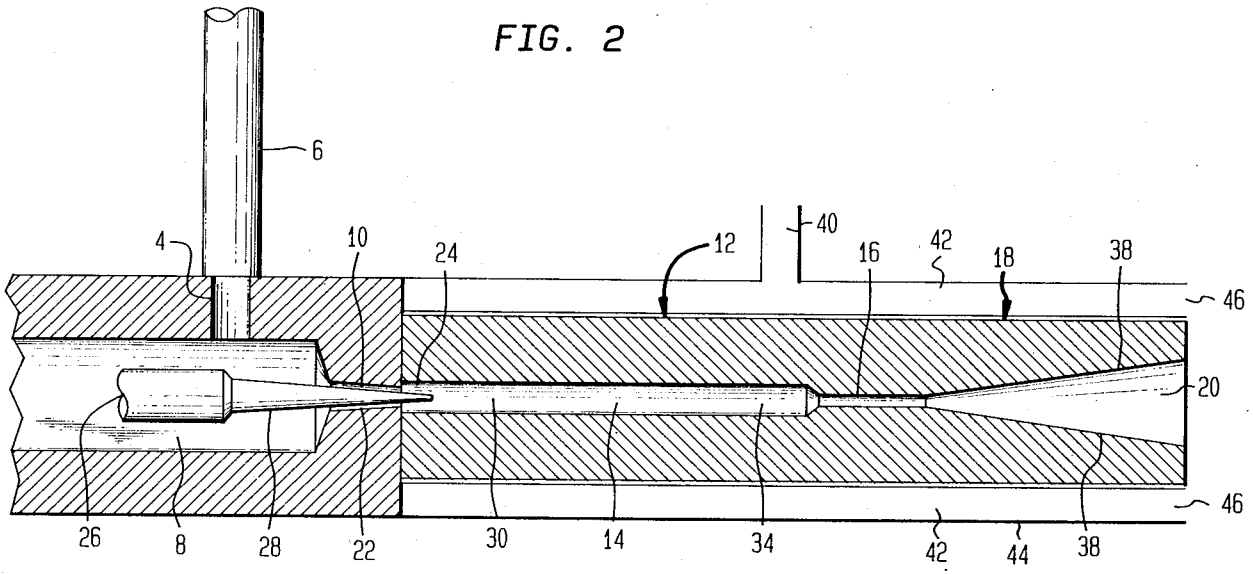
FIG. 2 is a cross-sectional elevational view of another embodiment of the invention which includes means for generating a dry nitrogen stream surrounding the solid/gaseous mixture of carbon dioxide at the point of contact with the substrate.

Referring to FIG. 2, the apparatus previously described as shown in FIG. 1 contains a nitrogen gas receiving port 40 which provides a pathway for the flow of nitrogen from a nitrogen source (not shown) to an annular channel 42 defined by walls 44. The annular channel 42 has an exit port 46 through which the nitrogen flows toward the substrate surrounding the solid/gas carbon dioxide mixture exiting at exit port 20. The nitrogen may be supplied to the annular channel 42 at a pressure sufficient to provide the user the needed sheath flow at ambient conditions.

Figure 3:
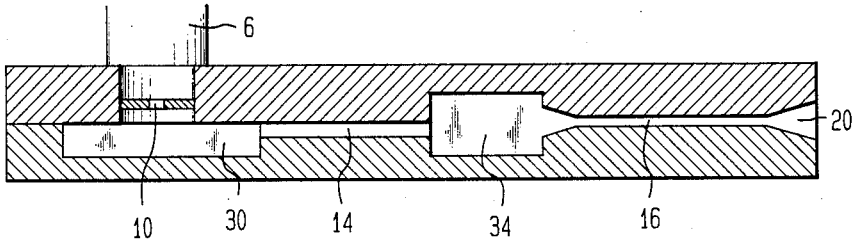
FIG. 3 is a cross-sectional elevational view of an embodiment of the present invention which permits cleaning of a wide area in comparison with the embodiments shown in FIGS. 1 and 2.
Figure 4:
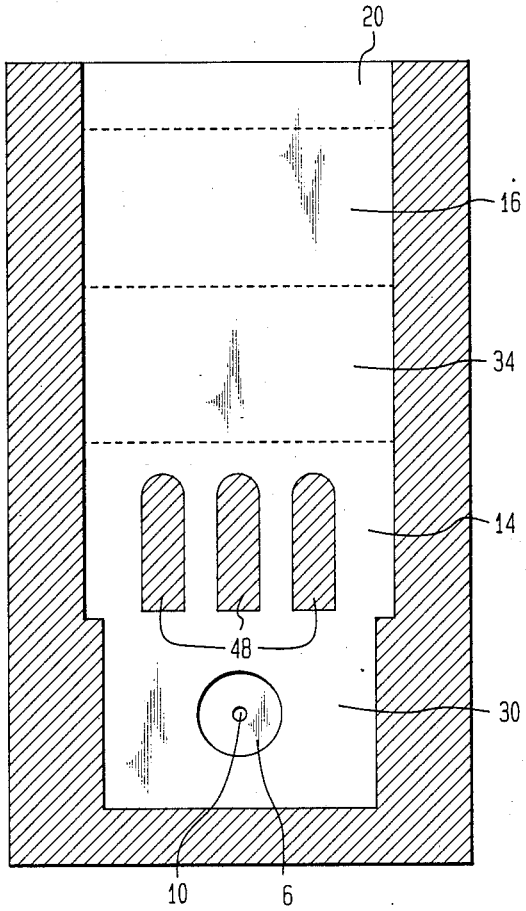
FIG. 4 is a top elevational view of the embodiment shown in FIG. 3.
Figure 5:
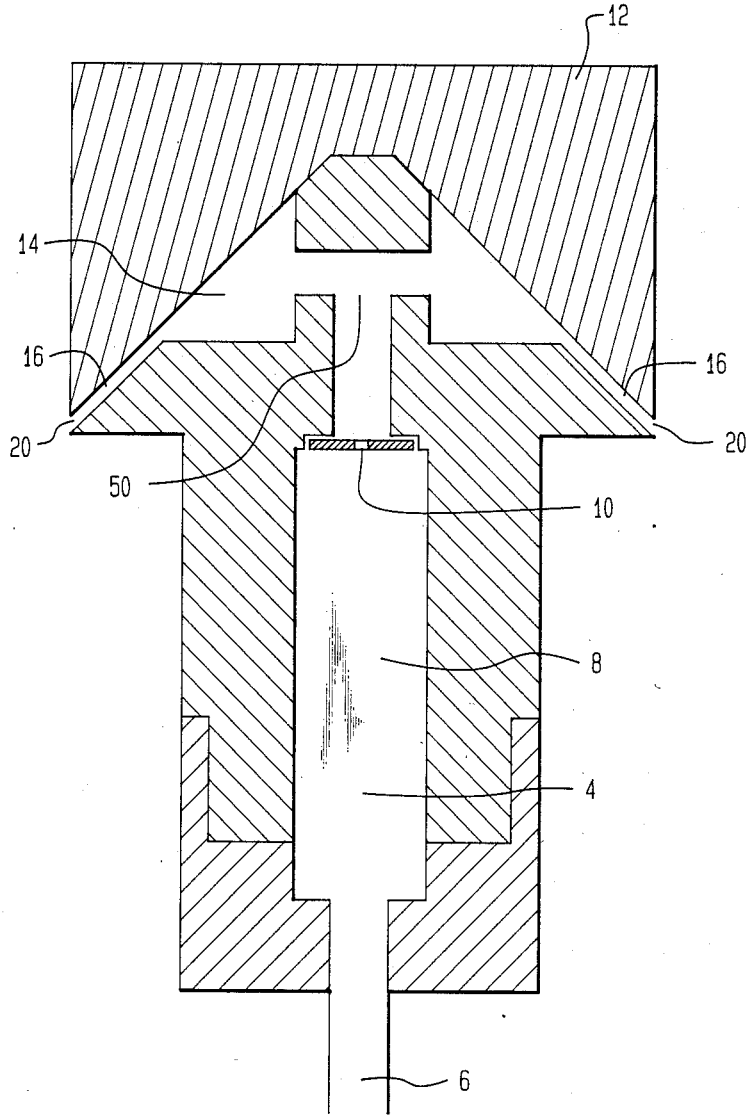
FIG. 5 is a cross-sectional elevational view of an embodiment of the present invention which may be utilized for cleaning the inside surface of cylindrical structures.

FIGS. 3, 4 and 5 illustrate additional embodiments of the present invention. The structure shown in FIGS. 3 and 4 has a flat configuration and produces a flat spray ideal for cleaning flat surfaces in a single pass. This configuration is particularly suitable for surface cleaning silicon wafers during processing when conventional cleaning techniques utilized on unprocessed wafers cannot be used due to potential harmful effects on the structures being deposited on the wafer surface. The designations in FIGS. 3, 4 and 5 are the same as utilized in FIGS. 1 and 2.

In FIG. 3, the flat spray embodiment is illustrated in cross-sectional view, and the same device is shown in top view in FIG. 4. Fluid carbon dioxide from the storage tank (not shown) enters the apparatus via the connecting means 6 through the first orifice 10. The coalescing chamber consists of a rear portion 30 and a forward portion 34 which make up the coalescing chamber 14. A single coalescing chamber 14 having the same width as the exit port 20 will be adequate. However, the pressure of the device requires that there be mechanical support across the width of the coalescing chamber 14. Accordingly, a number of mechanical supports 48 are spaced across the coalescing chamber 14 as shown in FIG. 4. The number of channels formed in the coalescing chamber 14 is solely dependent on the number of supports 48 required to stablize an exit Port 20 of a given width. It will be appreciated that the number and size of the resulting channels must be such as to not adversely effect the consistency and quality of the carbon dioxide being supplied to the inlet of the second orifice 16.

The larger liquid droplets/gas mixture which forms in the forward section 34 of the coalescing chamber forms into a solid/gas mixture as it proceeds through the second orifice 16 and out of the exit port 20, both of which have elongated openings to produce a flat, wide spray. The height of the openings in the second orifice 16 is suitably from about 0.001 to about 0.005 inch. Although the height of the opening can be less, 0.001 inch is a practical limit since it is difficult to maintain a uniform elongated opening substantially less than 0.001 inch in height. Conversely, the height of the second orifice 16 can be made greater than 0.005 inch which does produce intense cleaning. However, at heights above 0.005 inch, the amount of carbon dioxide required to improve cleaning increases substantially. These dimensions are given as illustrative since there is no fundamental limit to either the width or the height of the second orifice 16. The angle of divergence of the exit port 20 is slight, i.e. from about 4° to 8°, preferably about 6°. The apparatus shown in FIGS. 3 and 4 has been demonstrated to produce excellent cleaning of flat surfaces, such as silicon wafers.

The embodiment of the present invention shown in FIG. 5 is intended for cleaning of the inside of cylindrical structures. It is typically mounted on the end of a long tubular connector means 6 through which fluid carbon dioxide is transported from a storage means (not shown). In operation, the device shown in FIG. 5 is inserted into the cylindrical structure to be cleaned, the fluid carbon dioxide turned on, and the device slowly withdrawn from the structure. The umbrella-shaped jet formed by the structure sweeps the interior surface of the cylindrical structure and the vaporized carbon dioxide carries released surface particles along as it exits the tube in front of the advancing jet.

In the embodiment shown in FIG. 5, fluid carbon dioxide from a source not shown enters the device through connecting means 6. The fluid carbon dioxide enters the apparatus through the entry port 4 into a chamber 8. The chamber 8 is connected via a first orifice 10 to a nozzle 12. The nozzle 12 includes port 50 which lead to a coalescing chamber 14 and an exit port 20. In the embodiment shown in FIG. 5, the exit port 20 and the second orifice 16 are combined.

In the apparatus shown in FIG. 5, there is no divergence of the combined second orifice/exit port 20 since the orifice itself is divergent by nature due to its increasing area with increasing radius. The angle of incline of the second orifice/exit port 20 must be such that the carbon dioxide caroms from the surface to be cleaned with sufficient force to carry dislodged particles from the surface out of the structure in advance of the umbrella-shaped jet. On the other hand, the angle cannot be too acute so as to deter from the cleaning capacity of the jet. In general, the second orifice/exit port 20 is inclined from the axis by about 30° to 90°, preferably about 45°, in the cleaning direction of the apparatus.

Pure carbon dioxide may be acceptable for many applications, for example, in the field of optics, including the cleaning of telescope mirrors. For certain applications, however, ultrapure carbon dioxide (99.99% or higher) may be required, it being understood that purity is to be interpreted with respect to undesirable compounds for a particular application. For example, mercaptans may be on the list of impurities for a given application whereas nitrogen may be present. Applications that require ultrapure carbon dioxide include the cleaning of silicon wafers for semiconductor fabrication, disc drives, hybrid circuit assemblies and compact discs.

For applications requiring ultrapure carbon dioxide, it has been found that usual nozzle materials are unsatisfactory due to the generation of particulate contamination. Specifically, stainless steel may generate particles of steel, and nickel coated brass may generate nickel. To eliminate undersirable particle generation in the area of the orifices, the following materials are preferred: sapphire, fused silica, quartz, tungsten carbide, and poly(-tetrafluoroethylene). The subject nozzles may consist entirely of these materials or may have a coating thereof. The invention can effectively remove particles, hydrocarbon films, particles embedded in oil and finger prints. Applications include, but are not limited to the cleaning of optical aparatus, space craft, semiconductor wafers, and equipment for contaminant-free manufacturing processes.

While the present invention has been particularly described in terms of specific embodiments thereof, it will be understood that numerous variations of the invention are within the skill in the art, which variations are yet with the instant teachings. Accordingly, the present invention is to be broadly construed and limited only by the scope and the spirit of the claims appended hereto.

EXAMPLE 1

Apparatus in accordance with the present invention was constructed as follows. A cylinder of Grade 4 Airco carbon dioxide equipped for a liquid withdrawal was connected via a six foot length wire reinforced poly(tetrafluoroethylene) flexible hose to storage chamber 8 (see FIG. 1). The first orifice 10 connecting the storage chamber 8 and the coalescing chamber 14 was fitted with a fine metering valve 26 (Nupro S-SS-4A).

The nozzle 12 was constructed of ¼ inch O.D. brass bar stock. The coalescing chamber 14 had a diameter of 1/16 inch measured two inches from the opening 24 to the second orifice 16 having a length of 0.2 inch and an internal diameter of 0.031 inch. The ejection spout 18 was tapered at a 6° angle of divergence from the end of the second orifice 16 to the exit port 20 through a length of about 0.4 inch.

Test surfaces were prepared using two inch diameter silicon wafers purposely contaminated with a spray of powdered zinc containing material (Sylvania material #2284) suspended in ethyl alcohol. The wafers were then sprayed with Freon from an aerosol container.

In preparing to clean the above-described substrate in accordance with the present invention, the Nupro valve 26 was adjusted to give a carbon dioxide flow rate of approximately ⅓ SCFM. The nozzle 12 was operated for about five seconds to get the proper flow of carbon dioxide particles and then was positioned about 1½ inches from the substrate at about a 75° angle with respect to the substrate surface.

Cleaning was done by moving the nozzle manually from one side to the other side of the wafer. The cleaning process was momentarily discontinued at the first sign of moisture condensing on the wafer surface. Ultraviolet light was used to locate grossly contaminated areas that were missed in the initial cleaning run. These areas were then cleaned as described above.

The resulting cleaned wafer was viewed under an electron microscope to automatically detect selected particulates containing zinc. The results are shown in Table 1.

TABLE 1

| Particle Size | % particles removed |
|---|---|
| 1.0 micron | 99.9 + % |
| 0.1 to 1.0 micron | 99.5% |

We claim:

1. Apparatus for removing small particles from a substrate comprising:

(a) A source of pure fluid carbon dioxide under pressure and having an enthalpy of below about 135 BTU per pound based on an enthalpy of zero at 150 psia for a saturated liquid, so that a solid fraction will form upon expansion of the fluid carbon dioxide to the ambient pressure of said substrate;

(b) a first expansion means for expanding a portion of the fluid carbon dioxide obtained from the source into a first mixture containing gaseous carbon dioxide and fine droplets of liquid carbon dioxide;

(c) a coalescing means operatively connected to the first expansion means for converting said first mixture into a second mixture containing gaseous carbon dioxide and larger liquid droplets of carbon dioxide;

(d) a second expansion means operatively connected to the coalescing means for converting said second mixture into a third mixture containing discrete, minute solid particles of carbon dioxide not normally resolvable by the human eye and gaseous carbon dioxide; and (e) means connected to said second expansion means for directing said third mixture toward the substrate.

2. The apparatus of claim 1 further comprising means for directing a stream of nitrogen gas toward said substrate, said stream surrounding said third mixture as the third mixture contacts the substrate.

3. The apparatus of claim 1 further comprising means for controlling the rate of flow of fluid carbon dioxide into the first expansion means.

4. The apparatus of claim 3 wherein the control means comprises a needle valve.

5. The apparatus of claim 1 wherein the first expansion means comprises a first orifice having a first opening in communication with the source of fluid carbon dioxide and a second opening leading to said coalescing means, said coalescing means comprising a coalescing chamber having a rearward section in communication with said second opening, said rearward section having a cross-sectional area greater than the cross-sectional area of the first orifice to thereby enable the fluid carbon dioxide flowing through the first orifice to undergo a reduction of pressure as the fluid carbon dioxide enters the rearward section of the coalescing chamber to thereby form said first mixture.

6. The apparatus of claim 5 wherein the coalescing chamber further comprises a forward section adjacent said rearward section and having an opening leading to a second orifice wherein the first mixture undergoes coalescing of the fine drops into larger drops of liquid carbon dioxide during the passage from said rearward to said forward section to thereby form said second mixture.

7. The apparatus of claim 6 wherein the second expansion means comprises said second orifice having an opening at one end leading to the forward section of the coalescing chamber and another end opening into said third mixture directing means, said orifice having a cross-sectional area less than the cross-sectional area of the forward section of the coalescing chamber.

8. The apparatus of claim 7 wherein the means for directing said third mixture comprises a divergently tapered channel connected an one end to the second orifice and having an exit port through which the third mixture exits and contacts the substrate.

9. The apparatus of claim 5 wherein the coalescing chamber has a length of about 0.125 to 2.0 inches and a diameter of about 0.03 to 0.125 inch.

10. The apparatus of claim 5 wherein the first orifice has a width of about 0.001 to 0.05 inch.

11. The apparatus of claim 8 wherein the divergently tapered channel has an angle of divergence of up to 15°.

12. The apparatus of claim 11 wherein the divergently tapered channel has an angle of divergence of about 4° to 8°.

13. The apparatus of claim 1 wherein the second expansion means and the means for directing the third mixture toward the substrate are combined.

14. The apparatus of claim 5 wherein the forward section of said coalescing means and said directing means have elongated openings, thereby producing a wide flat spray.

15. A method for removing particles from a substrate surface comprising:

(a) converting pure fluid carbon dioxide into a first mixture of fine droplets of liquid carbon dioxide and gaseous carbon dioxide;

(b) converting said first mixture into a second mixture containing larger droplets of liquid carbon dioxide and gaseous carbon dioxide;

(c) converting said second mixture into a third mixture containing discrete, minute solid carbon dioxide particles not normally resolvable by the human eye and gaseous carbon dioxide; and (d) directing said third mixture toward the substrate whereby said third mixture removes said particles from the substrate.

16. The method of claim 15 further comprising storing the fluid carbon dioxide at a pressure of about 300 to 1,000 psia.

17. The method of claim 16 wherein step (a) comprises expanding the fluid carbon dioxide along a constant enthalpy line to about 80 to 100 psia.

18. The method of claim 15 wherein the first mixture comprises about 50% of fine liquid droplets and about 50% of carbon dioxide vapor.

19. The method of claim 15 wherein the first mixture comprises about 11% of fine liquid droplets and about 89% of vapor.

20. The method of claim 15 wherein the amount of carbon dioxide used to form said first mixture is about 0.25 to 0.75 standard cubic foot per minute.

* * * * *